US005499789A

United States Patent [19]

Rose

[11] Patent Number: 5,499,789

[45] Date of Patent: Mar. 19, 1996

[54] ANTI ROTATION SIGN HANGING SYSTEM

[75] Inventor: Sidney Rose, Marblehead, Mass.

[73] Assignee: Rose Displays Ltd., Marblehead, Mass.

[21] Appl. No.: 980,328

[22] Filed: Nov. 23, 1992

[51] Int. Cl.[6] ..... A47G 1/16

[52] U.S. Cl. ..... 248/489; 40/617; 248/317

[58] Field of Search ..... 248/489, 497, 248/317, 339, 300; 40/617

[56] References Cited

U.S. PATENT DOCUMENTS

| | | | |
|---|---|---|---|
| 1,561,755 | 11/1925 | Taseff | 248/317 X |
| 2,092,121 | 9/1937 | Johnson | 248/317 |
| 3,327,376 | 6/1967 | Freeman et al. . | |
| 3,952,985 | 4/1976 | Davenport | 248/489 X |
| 4,025,019 | 5/1977 | Jacobsen et al. | 248/317 |
| 4,135,692 | 1/1979 | Ferguson . | |
| 4,163,576 | 8/1979 | Hoop . | |
| 4,191,352 | 3/1980 | Schuplin | 248/317 |
| 4,225,108 | 9/1980 | Jaroche . | |
| 4,269,087 | 5/1981 | Wand . | |
| 4,284,219 | 8/1981 | Standel, Jr. | 248/317 X |
| 4,323,215 | 4/1982 | Berger . | |
| 4,392,283 | 7/1983 | Timmons | 248/317 X |
| 4,520,984 | 6/1985 | Rouleau | 248/489 X |
| 4,564,165 | 1/1986 | Grant et al. . | |
| 4,811,475 | 3/1989 | Morton, Jr. | 248/317 X |

FOREIGN PATENT DOCUMENTS

| | | | |
|---|---|---|---|
| 878507 | 10/1961 | United Kingdom | 248/317 |
| 1076631 | 7/1967 | United Kingdom | 248/317 |

*Primary Examiner*—Ramon O. Ramirez
*Assistant Examiner*—Derek J. Berger
*Attorney, Agent, or Firm*—Don Halgren

[57] ABSTRACT

An anti-rotation assembly for supportively hanging signs or the like, comprising a ceiling anchor having a clip which permits attachment of a suspender rod thereto. Each clip/anchor relationship with the suspender rod prevents rotation therebetween. The lower end of the suspender rod also has a hooked end which engages a further clip attached to a sign. This further clip and hook relationship at the lower end of the suspender rod also prevents rotation therebetween. The complete assembly being sufficiently rigid so as to prevent any rotation of the sign with respect to the anchor which itself is attachable to a horizontal portion of a window casing or a ceiling.

16 Claims, 4 Drawing Sheets

ANTI ROTATION SIGN HANGING SYSTEM

BACKGROUND OF THE INVENTION (1) Field of the Invention

This invention relates to hanger arrangements for suspending articles from overhead support surfaces.

(2) Prior Art

Signs and overhead articles are common in retail businesses today, as may be evidenced in any commercial establishment in the country.

Visibility is the requirement for these objects such as signs, cameras, clocks or the like may be hung from the ceiling optimize that visibility, with minimum use of space and obtrusiveness.

Signs or like objects, may be suspended from ceilings, window mullions, or other raised horizontal surfaces, by a plurality of suspension means per sign as shown for example, in U.S. Pat. No. 5,052,733 to Cheung et al. Inverted "T" rails are common forms of ceiling panel securement, and sign suspensions are usually attached to those rails by various clips, magnets or the like. The signs are typically put in place onto those rails by two people, each climbing a ladder and/or lifting a pole (or one person doing it twice) having a distal end which supports an anchoring magnet, adhesive fixture or spring clip, to which a suspender means is attached, from the upper edge of the sign.

Two suspension hangers keep the signs from twisting away from the desired direction, that which is the most likely to be seen by passing customers.

An example of clips attached to a ceiling rail is shown in U.S. Pat. No. 4,269,087 to Wand. Some rather complicated attachment devices are shown in U.S. Pat. No. 4,163,576 to Hoop, and in U.S. Pat. No. 4,135,692.

It is however, a necessity of these hanger devices, to have them hung in pairs of anchors and rods so as to prevent twisting or rotation of signs, and also a requirement that the signs to which they mate, be assembled or installed onto the ceiling, and removed therefrom, by two people each time, or one person doing the operation twice.

It is an object of the present invention to provide a sign hanging means which will not permit a sign hung therewith to twist or rotate, yet will require only a single anchor means.

It is also an object of the present invention, to permit a sign to be attached to a ceiling support, by a single individual operation, not the typical two individuals or dual operation commonly required.

BRIEF SUMMARY OF THE INVENTION

The present invention involves a system for hanging objects such as signs or the like, from any horizontal surface such as ceiling or window mullion anchors, typically for use within commercial business establishments, to permit a commercial in-store, office or factory type sign to be hung with a single suspension member.

The suspension member typically comprises an elongated suspender rod having a bend such as a "J" shaped (approx.) 270 degree hook arranged at each end thereof. The elongated rods may be of various lengths, dependent upon the level from the ceiling (or other horizontal surface) at which one wishes to hang the sign.

Each end of the hook, when it supports its own particular sign, in one embodiment, mates with a clip that engages the hook at two points, thus preventing it from twisting or pivoting, at that juncture.

The particular clip at the upper or ceiling end of the suspender rod might be unitary with (or separate) and extend from a single magnetic anchor or other adhesively attachable ceiling securement unit, screw anchor, wire clip anchor or the like.

The particular hook at the lower end of the suspender rod (when only one suspender rod is utilized) is preferably attachable to the mid-point of the upper edge of a sign. The upper edge of the sign may have an elongated rail to hold the sign and keep it from folding or curling. The critical feature of this embodiment of the invention is that the clips at the upper and lower end of the rigid suspender rod engage each end of that suspender rod at two contact points, thus providing a resistance to rotation or twisting of that sign with respect to the ceiling anchor device.

The hook end of each rod typically has a reverse bend or about a 270 degree hook with a radius of about 1 cm. (diam. approx. 2 cm.). A clip which engages each hook may have, for example, a length of about 0.6 to about 0.8 cm. The portion of the clip which engages the hook will be of generally U-shape in cross-section, with a spacing, for example, of about 0.3 cm to about 0.5 cm between the leg components of that U-shaped portion of the clip. The clip therefore, may be made of a narrow strip of formed metal, or extruded plastic.

An important feature of this embodiment of the invention being the length of all of the clips are sufficient to grip each hook end of each suspender rod at two spaced apart locations to inhibit rotation of that clip with respect to the suspender rod and to the ceiling support (anchor).

The invention thus comprises a system for supporting a display sign or the like, to a horizontal surface such as a ceiling or window frame utilizing an elongated rigid suspender rod arrangement having a curvilinear hook disposed on each end thereof; a clip matable with said hook on each end thereof, and adapted to have at least two contact points therebetween, said clips arranged in conjunction with a ceiling securement base and a sign, the multi contact points between said respective clips and hooks preventing rotation therebetween thus preventing rotation of a sign secured to a ceiling by a single elongated hook rod.

A further embodiment of this invention is that the end of the suspender rod may be of "L" or even a "J" shape to engage its respective clip in a line of contact, thus also preventing relative rotation between the rod and a clip.

The overall system also includes the clip which has a generally "U" shaped body having a pair of generally parallel side portions connected by a bridging portion, said bridging portion having a longitudinal dimension sufficient to permit a hook of the suspender rod to contact it at two points.

The clip has a pair of openings which extend across the generally parallel side portions of said clip, so as to permit the suspender rod to engage said clip in a plane transverse to the longitudinal axis of said clip.

The invention also comprises a clip for supporting an elongated suspender rod with a sign and for supporting said elongated suspender rod to a ceiling comprising: a formed body having a pair of generally parallel side portions connected by a bridging portion, said bridging portion having a longitudinal dimension sufficient to permit a curvilinear hook to contact its opposed longitudinal edges defining two contact points, to prevent rotative motion between said clip and a hook engaged therewith. The clip for supporting an elongated suspender, has parallel side portions which have at least one opening through each side thereof, to provide a pair of contact points for a the curved hook end of a suspender rod therethrough. The clip for supporting an elongated suspender, may include each side portion of said clip having at least two holes therethrough.

The invention includes a method of nonrotatively supporting a sign from a horizontal surface, comprising the steps of: attaching a suspender rod from an anchor supportable from a ceiling or horizontal surface, attaching the rod to a sign clip which is attached to a sign, and raising the assembly of said anchor, clips, suspenders and sign into engagement with a horizontal surface for display of the sign therefrom.

The clip is adapted to engage said suspender rod in either one of two different orientations, each orientation establishing two contact points between said suspender rod and said clip or in an alternative embodiment, in a line of contact between the suspender rod and the clip, when the hook end of the rod is of "L" or "J" shape. The clip is of an elongated "C" shape, having side portions which define between them, said two orientations for establishing contact points between said suspender rod and said clip. The side portions have an opening thereacross, permitting a bent portion of one end of said suspender rod to extend therethrough and engage said clip at said two points thereby, comprising one of said orientations. The side portions have a fold which together define a "U" shaped bridging portion therebetween, for matably receiving a bent portion of one end of a suspender rod extended between said side portions.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
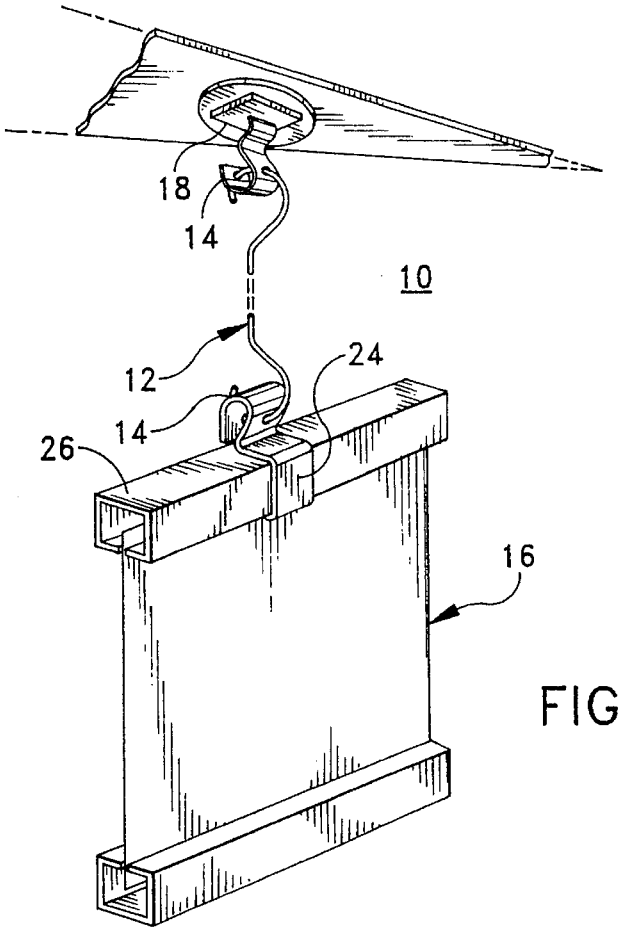
FIG. 1 shows a sign supported from a ceiling by an anti rotative support system constructed according to the principles of the present invention.

Referring now to the drawings in detail, and particularly to FIG. 1, there is shown in perspective view an anti-rotative single suspender rod sign support system 10.

The support system 10 comprises a single elongated rigid suspender 12 having curved or angular bend with respect to the longitudinal axis of the suspender rod, such as for example, about a 270 degree curved hook 14 at each end thereof, as shown in FIG. 1. The typical rigid suspender rod is about 0.2 cm in diameter, made from metal or plastic, and may be of various lengths, depending upon the distance from the ceiling the sign is to be hung.

Each curved/bent (hook) end 14 of a suspender rod 12, when it supports a particular sign 16, mates with a securement clip which touches each curved hook 14 at two points, which in this embodiment, is critical to its preventing rotation between the sign 16 and its single elongated hook rod 12 and between the single elongated hook rod 12 and a ceiling securement unit 18.

Figure 8:
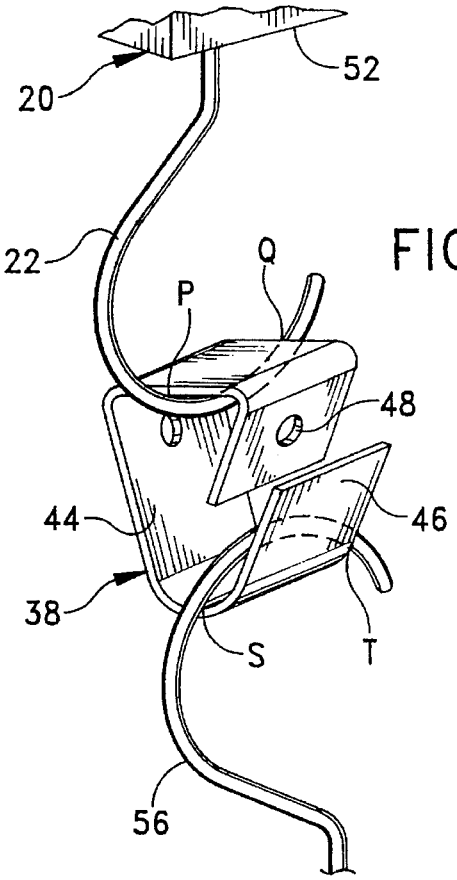
FIG. 8 is a view of the clip shown in FIG. 4 arranged between a ceiling anchor and a suspender rod both extending longitudinally therethrough.
Figure 9:
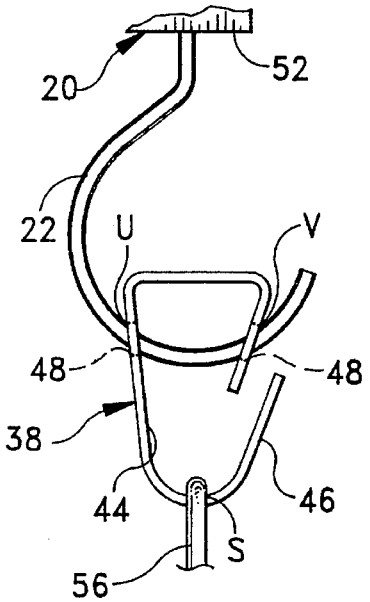
FIG. 9 is a view of the clip shown in FIG. 5 arranged between a ceiling anchor base extending transversely of the clip a suspender rod which would be attached to a sign at its other end, for supporting same.

The clip at the upper end of the elongated suspender rod 12 could be molded into and integral with the ceiling securement (anchor) unit 18 itself, as shown in FIGS. 1, 9, and later in FIGS. 10, 11 and 12, or it may alternatively be anti-rotatively attached to a ceiling anchor 20, as shown in FIGS. 8 and 9, which show a curvilinear hook 22 adapted to an intermediate anti-rotative clip 38, as will be discussed hereinbelow. It is to be noted that the ends of the suspender rod could be "V", "L", or "U" shaped, or otherwise, as long as in this embodiment, it permits two locations thereof to engage its respective clip, or one line of contact in a further embodiment, as discussed hereinbelow.

The hook 14, in FIG. 1, at the lower end of the elongated suspender rod 12 (for a single support rod), is attached to a clip 24 arranged at the mid-point of the upper edge of the sign 16. The upper edge of the sign 16 may have an elongated rail 26 attached along the entire length thereof, to keep it from folding or curling undesirably, or the sign could be stiff enough to just be secured to the clip by itself.

Figure 2:
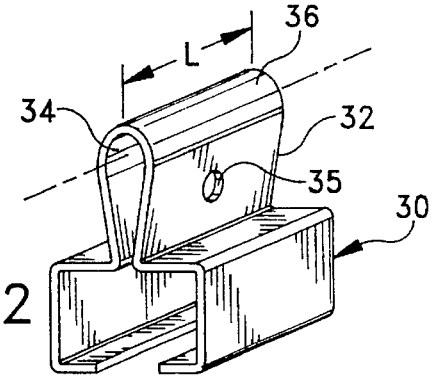
FIG. 2 is a perspective view of a first clip adaptable to a sign support.
Figure 3:
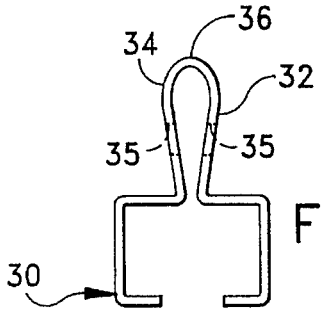
FIG. 3 is a side view of the clip shown in FIG. 2.

FIGS. 2 and 3 show a clip 30 which is generally similar to the clip 24 shown in FIG. 1. The clip 30 is of generally "U"-shape having a first leg 32 and a second leg 34 connected by a bridging portion 36. The clip 30 has a length "L" of about 0.6 to about 0.8 cm, though a longer length may be satisfactory. The legs 32 and 34 are spaced apart by about 0.3 to about 0.5 cm, and are pinched toward one another slightly, as shown in FIG. 3.

The clip 30 may be a type of securement which would connect the lower end of a hook rod 12 to a sign 16.

The clip 30 has a pair of openings 35 which extend across the legs 32 and 34. The openings 35 are of a diameter slightly larger than the hook rod 12. The openings 35 provide a pair of spaced apart contact points on the legs 32 and 34.

Figure 4:
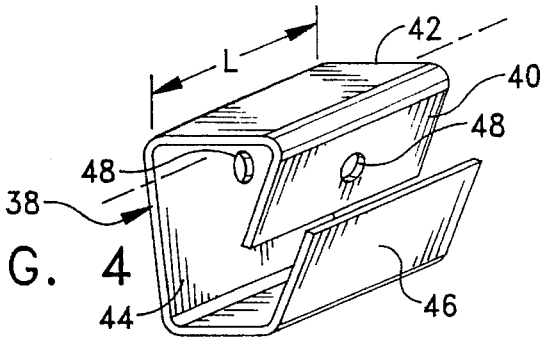
FIG. 4 is a perspective view of a further clip adaptable to a ceiling anchor base.
Figure 5:
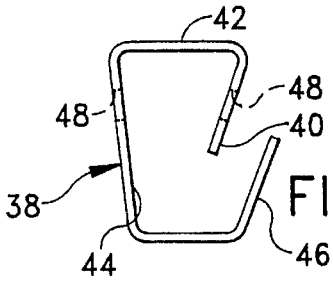
FIG. 5 is a side view of the clip shown in FIG. 4.

A further type of clip adaptable to the anti-rotative sign support system 10, is shown in FIGS. 4 and 5, and is a clip 38 of an elongated "C" shape. The clip 38 has a first leg 40 arranged at an acute angle with respect to a bridging portion 42, and an extended back 44 which curves around to a second leg 46 in an obtuse open configuration. The length L of the further clip 38 may be preferrably the same length as the first clip 36.

The further clip 38 has a pair of openings 48 which are disposed spaced across from one another in the first leg 40 and extended back 44 as shown in figures. The openings 48 provide a pair of spaced apart contact points on the leg and back 40 and 44. It is to be noted that the clip 38 could have a second pair of openings 48' as shown in FIG. 8A, where an anchor 39 is attached to a horizontal surface 41. The anchor 39 therein, includes a downwardly directed hook 37 of similar diameter as the suspender 12. The hook 37 meets the clip 38 at two points E and F. The clip 38 in FIG. 8A has two pairs of openings 48' through which a pair of suspender rods 43 and 45 mate, each contacting the clip 38 at two points G and H. The lower end of the suspenders 43 may be attached to a sign, not shown, through a clip such as shown as FIGS. 6 and 7, and described herein.

It is to be noted that at the longitudinal ends of each bridging portion 36 and 42 of clip 30 and 38 respectively provide the spaced apart contact points for any hook longitudinally disposed therewithin.

Figure 6:
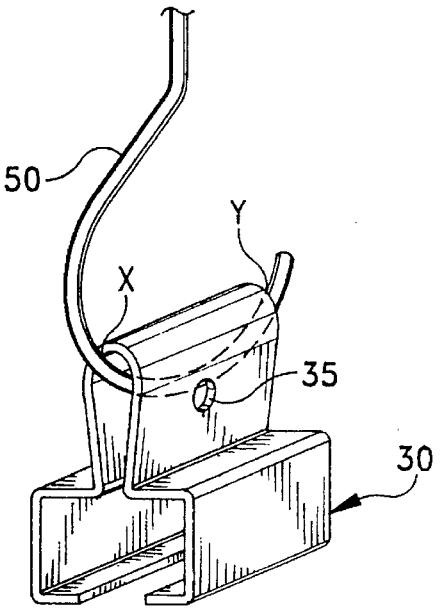
FIG. 6 is a view of the clip shown in FIG. 2, with a suspender rod arranged in the longitudinal plane of the clip.

A typical hook 50, shown in FIG. 6, shown cut-off from its associated elongated rod for clarity, may be disposed in the longitudinal plane of the clip 30, so as to engage the clip 30 at two points X and Y. By engaging the hook 50 and clip 30 at those two points X and Y, rotative motion therebetween, is prevented.

Figure 7:
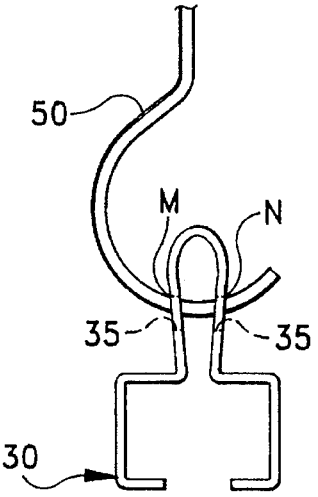
FIG. 7 is a view of the clip shown in FIG. 3, with a suspender rod arranged in the transverse plane of the clip showing an alternative way of securing the suspender rod.
Figure 8A:
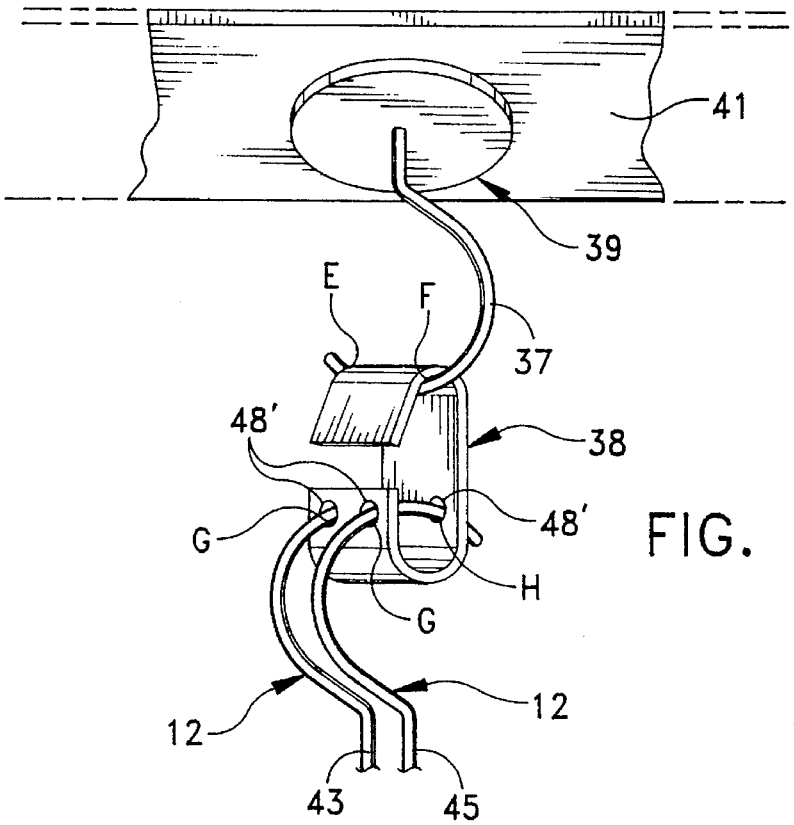
FIG. 8A is a view of an anchor, clip and pair of suspenders which may be arranged with respect to a sign.

The hook 50, is shown in a side view in FIG. 7, with the clip 30 likewise shown in a side view. The hook 50 in FIG. 7, extends transversely with respect to the longitudinal axis of the clip 30, through the openings 35, also establishing two contact points M and N between the hook 50 and the clip 30.

A securement anchor attachment hook 20 and 39 is shown in FIGS. 8, 8A, 8B and 9. The hooks 22 and 37 here may have a base anchor component 52 or 39 respectively, which is attachable to a horizontal member such as a ceiling element, such as at 41, shown in FIGS. 8A and 8B, such as by a magnet, by an adhesive pad, or a screw anchor or by a snap-on clip arrangement.

The curved hook portion 22 shown in FIG. 8, is shown disposed in the longitudinal plane of clip 38, similar to that described in FIGS. 4 and 5. The hook 22 engages the clip 38 at two points P and Q. A hook 56, comprising the upper end of an elongated support rod, is also shown disposed in the longitudinal plane of the clip 38, engaging it between its extended back 44 and its second leg 46 at two points S and T, thereby preventing rotation between the clip 38 and the upper and lower hooks 20 and 56.

Figure 8B:
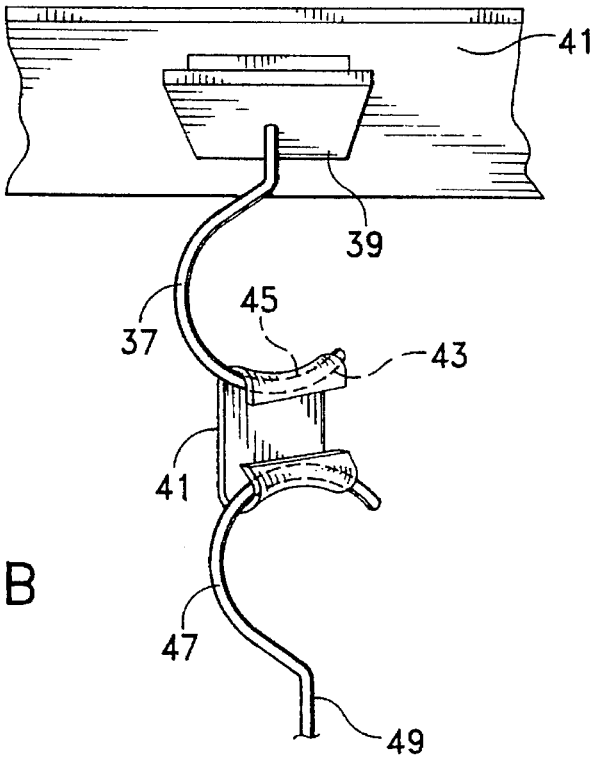
FIG. 8B is a view of a further embodiment of the clip shown in FIG. 8.

A further embodiment of the support system includes the hook 37 as shown in FIG. 8B which has a curved end 43 which engages a clip 41, in a curved line of contact 45. The upper end of the clip 41 is of "C" shape and has an end with a compound curve having a "saddle-like" configuration, the curved end 43 mating therewith in a curved trough. A hook 47, comprising the upper end of an elongated support rod 49 is disposed in the longitudinal plane of the clip 41, where it also may be engaged along a curved line of contact, thereby permitting only a slight swinging motion between the secured anchor 39 and a sign or other object secured to the other end, not shown, of the support rod 49.

FIG. 9 shows the securement base anchor hook 22 disposed transversely through the openings 48 of the further clip 38 so as to also contact the clip 38 at two other spaced apart points U and V. While the lower hook 56, connected to a further clip in an actual anti-rotative sign support system 10, would be prevented from rotation with respect to any component because of the two contact point arrangement between contiguous/adjacent components of this system.

Figure 10:
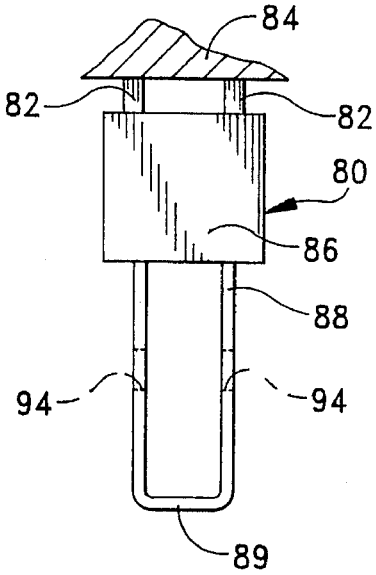
FIG. 10 is an end view of an anchor/clip combination attached to a horizontal support surface.
Figure 11:
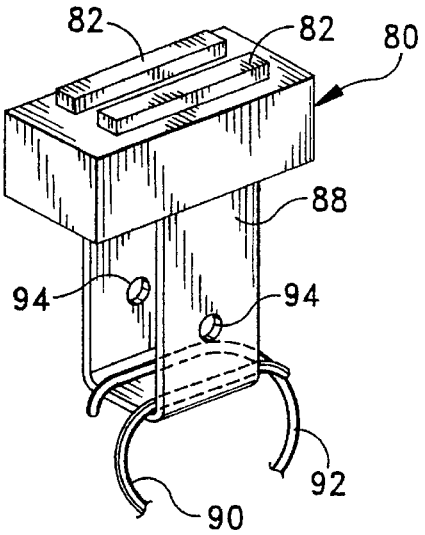
FIG. 11 is a perspective view of an anchor/clip similar to that shown in FIG. 10, with two support rods partially shown arranged therewith.

FIG. 10 shows an end view of a further embodiment of an anchor 80 having for example, a pair of parallel magnets 82 is shown, (though other securement means such as adhesive or the like would be satisfactory), for securement to a horizontal support surface 84, such as a ceiling rail or the like. The anchor 80 includes a block 86 into which a formed channel shaped clip 88 is molded. The clip 88 has a lower bridging portion 89 about 0.5 cm. across, which is wide enough to permit the upper end of one or two rigid suspender rods 90 and 92, as shown in FIG. 11, to be disposed therein, without twisting or rotating about its/their longitudinal axis/axes with respect to the anchor 80. A pair of holes 94 are disposed in the side portions of each clip 88, so that the upper end of a suspender rod 90 or 92 could be placed therethrough, (two pairs of holes would also fit here).

Figure 12:
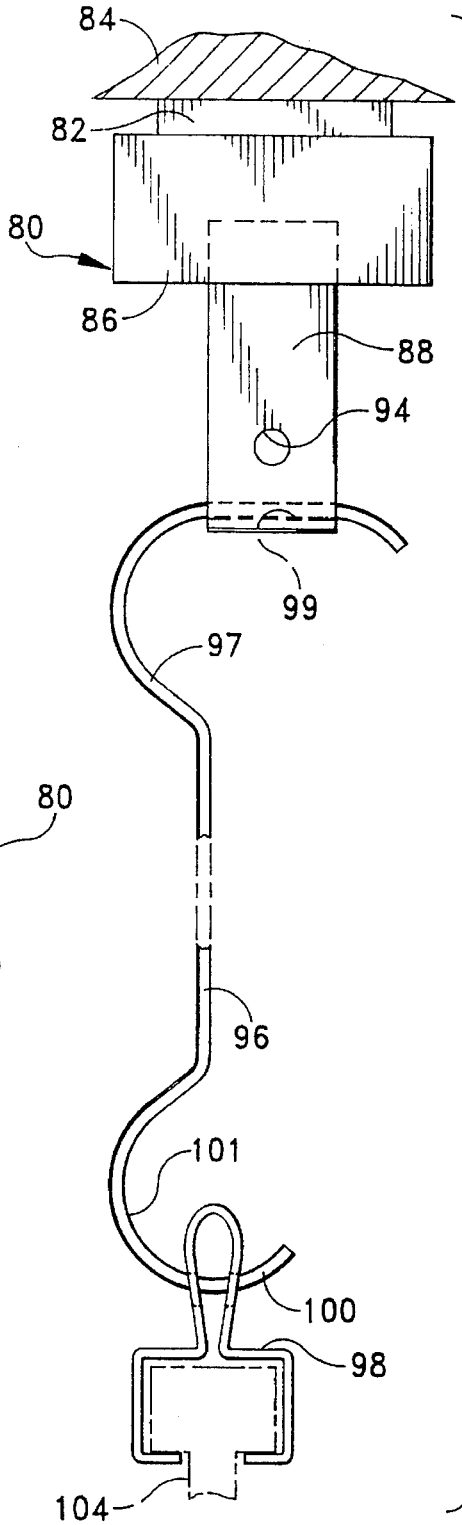
FIG. 12 is a side view of an anchor/clip combination attached to a horizontal support surface, in supportive contact with a support rod which is engaged onto a clip connected to a sign.

FIG. 12 shows an anti-rotative sign hanging system of the present invention wherein an anchor 80 is attached to a horizontal surface 84. A support rod 96 has an upper end 97 with an "L" shape thereto, providing a line of contact 99 between the upper end of the support rod 96 and the bridging portion of the anchor 80, with no axial rotation therebetween permitted. A clip 98, similar to the clip 30 which was shown in FIG. 3, is shown at the lower end 101 of the support rod 96, having a curvilinear end 100 engaging the clip 98 at two points, thus also preventing rotative motion between the lower clip 98 (and its attendent sign 104 shown in phantom), and the support rod 96.

Thus there has been shown a novel and unique apparatus for supporting signs or like objects, from a ceiling or other horizontal surface, by a single elongated suspender rod, or a pair of suspender rods, either embodiment attached to a single uppermost anchor, avoiding the unnecessary extra anchor components, as well as critically and significantly permitting only a single individual to raise and lower a non-rotatable sign assembly because of a single anchoring device the reattached.

I claim:

1. A system for supporting a display sign from a horizontal surface of a ceiling or window frame comprising, an anchor having means for securing itself to said horizontal ceiling or window frame surface, said anchor also comprising a first clip arranged therewith;

an axially elongated rigid suspender rod having two ends with a hook disposed on each of said ends thereof;

a further clip which is attachable to a sign to be supported, said axially elongated rigid rod with said hook on one end being matable with said first clip on said anchor adapted to prevent rotative motion between said first clip and said axially elongated rigid rod, said hook on the other end of said rigid rod being attached to said further clip also adapted to prevent rotative motion between said further clip and said axially elongated rigid rod, said sign thereby being supported from a horizontal support surface without any rotation between the anchor and a sign supported therebeneath, the system thus comprising a rigid rod non-rotatively secured through curved hooks at each end thereof, to an anchor and to a display sign, respectively.

2. A system for supporting a display sign as recited in claim 1, wherein at least one of said clips has a generally "U" shaped body having a pair of generally parallel side portions connected by a bridging portion, said bridging portion defining a longitudinal axis and having a longitudinal dimension sufficient to permit a hook of said suspender rod to contact it at two points.

3. A system for supporting a display sign as recited in claim 2, wherein at least one of said clips has a pair of openings which extend across the generally parallel side portion of said clip, so as to permit said suspender rod to engage said clip in a plane transverse to the longitudinal axis of said clip.

4. A system for supporting a display sign as recited in claim 2, wherein at least one end of said suspender rod has a curvilinear "J" shaped hook arranged thereon.

5. A system for supporting a display sign as recited in claim 2, wherein at least one end of said suspender rod has an "L" shaped hook arranged thereon.

6. A system for supporting a display sign as recited in claim 5, wherein said "L" shaped hook engages said clip in a line of contact to prevent relative rotation between said suspender rod and said clip.

7. The system for supporting a display sign as recited in claim 1, wherein said means for said anchor supporting itself comprises a magnet thereon.

8. The system for supporting a display sign as recited in claim 1, wherein said means for said anchor supporting itself comprises an adhesive disposed thereon.

9. The system for supporting a display sign as recited in claim 1, wherein at least one of said hooks on an end of said support rod has a curved end and mates with a clip having a curved trough therewith so as to provide a curved line of contact therebetween.

10. The system for supporting a display sign as recited in claim 1, wherein at least one of said hooks on an end of said support rod has an "L" shaped end and mates with a clip having a straight channel bridging its leg portions, so as to provide a straight line of contact therebetween.

11. A method of non-rotatively supporting a sign from a horizontal surface, comprising the steps of:

attaching only one anchor having a formed clip therewith to a rigid suspender rod having a pair of ends with a hook arranged at each end;

attaching said suspender rod to a further clip which further clip is attachable to a sign or object to be suspended to said horizontal surface; and raising the assembly of said one anchor, suspender rod, clip and sign into engagement with said horizontal surface for non-rotative display of the sign therefrom.

12. The method of claim 11, wherein each said clip is adapted to receivably engage said suspender rod in either one of two different orientations, each orientation establishing the non-rotative relationship between said suspender rod and said clip.

13. The method of claim 12, wherein at least one of said clips is of an elongated "C" shape, having side portions which define between them, said two orientations for establishing contact points between said hook end of said suspender rod and said clip.

14. The method of claim 13, wherein said side portions have an opening thereacross, permitting in one orientation thereof, said hook portion of one end of said suspender rod to extend therethrough and engage said one clip at said two points.

15. The method of claim 13, wherein said side portions have a fold which together define a "U" shaped bridging portion therebetween, for matively receiving a bent or hooked portion of one end of a suspender rod extended between said side portions.

16. The method of claim 13, wherein said hook of said suspender rod is of generally "L" shape, so as to permit a line of contact between said suspender rod and said one clip, thereby preventing relative rotation between said rod and said clip.

* * * * *